US006796359B1

(12) United States Patent
Knutson

(10) Patent No.: US 6,796,359 B1
(45) Date of Patent: Sep. 28, 2004

(54) PORTABLE FENCE SUPPORTED AWNING

(76) Inventor: Kraig R. Knutson, 1908 S. Henkel Cir., Mesa, AZ (US) 85202

( * ) Notice: Subject to any disclaimer, the term of this patent is extended or adjusted under 35 U.S.C. 154(b) by 0 days.

(21) Appl. No.: 10/322,913

(22) Filed: Dec. 18, 2002

(51) Int. Cl.[7] ..... E06B 3/92

(52) U.S. Cl. ..... 160/156; 160/46; 160/66; 160/67; 135/88.12

(58) Field of Search ..... 160/45, 46, 66, 160/67, 68, 156; 135/88.07, 88.12; 248/499

(56) References Cited

U.S. PATENT DOCUMENTS

| | | | | | |
|---|---|---|---|---|---|
| 1,215,728 | A | * | 2/1917 | Slauson | 160/145 |
| 3,906,969 | A | | 9/1975 | Myers | |
| 4,068,673 | A | | 1/1978 | Bernardi | |
| 4,422,491 | A | * | 12/1983 | Cusick, III | 160/58.1 |
| 4,719,954 | A | | 1/1988 | Curtis et al. | |
| 4,733,683 | A | | 3/1988 | Pozzi | |
| 4,846,205 | A | * | 7/1989 | Knoll | 135/154 |
| 4,976,487 | A | * | 12/1990 | Ramos et al. | 296/152 |
| 5,174,073 | A | | 12/1992 | Sabo | |
| 5,246,052 | A | | 9/1993 | Homan | |
| 5,280,687 | A | | 1/1994 | Boiteau | |
| 5,381,814 | A | | 1/1995 | Brandon | |
| 5,400,813 | A | | 3/1995 | Swan, Jr. | |
| 5,437,298 | A | | 8/1995 | Lin | |
| 5,531,239 | A | | 7/1996 | Hannah, Jr. | |
| 5,558,145 | A | | 9/1996 | Baka | |
| 5,632,318 | A | * | 5/1997 | Wang | 160/370.21 |
| 5,800,067 | A | * | 9/1998 | Easter | 383/104 |
| 5,860,440 | A | | 1/1999 | Murray et al. | |
| 5,931,176 | A | * | 8/1999 | Isler et al. | 135/88.15 |
| 6,050,280 | A | | 4/2000 | Jeske | |
| 6,123,091 | A | * | 9/2000 | Flynn et al. | 135/96 |
| 6,257,259 | B1 | * | 7/2001 | Ardouin | 135/88.07 |
| 6,431,193 | B2 | * | 8/2002 | Carter | 135/145 |

* cited by examiner

*Primary Examiner*—Bruce A. Lev
(74) *Attorney, Agent, or Firm*—John D. Lister

(57) ABSTRACT

A portable fence supported awning includes a flexible sheet mounted on a frame that has a rear frame cross member and two sets of lateral frame members. The two sets of lateral frame members are attached to the fence and can support the awning in various positions to provide the desired cover. The lateral frame members can be pivoted into and the flexible sheet can be folded into a compact state for carrying and storage.

13 Claims, 6 Drawing Sheets

FIG. 1
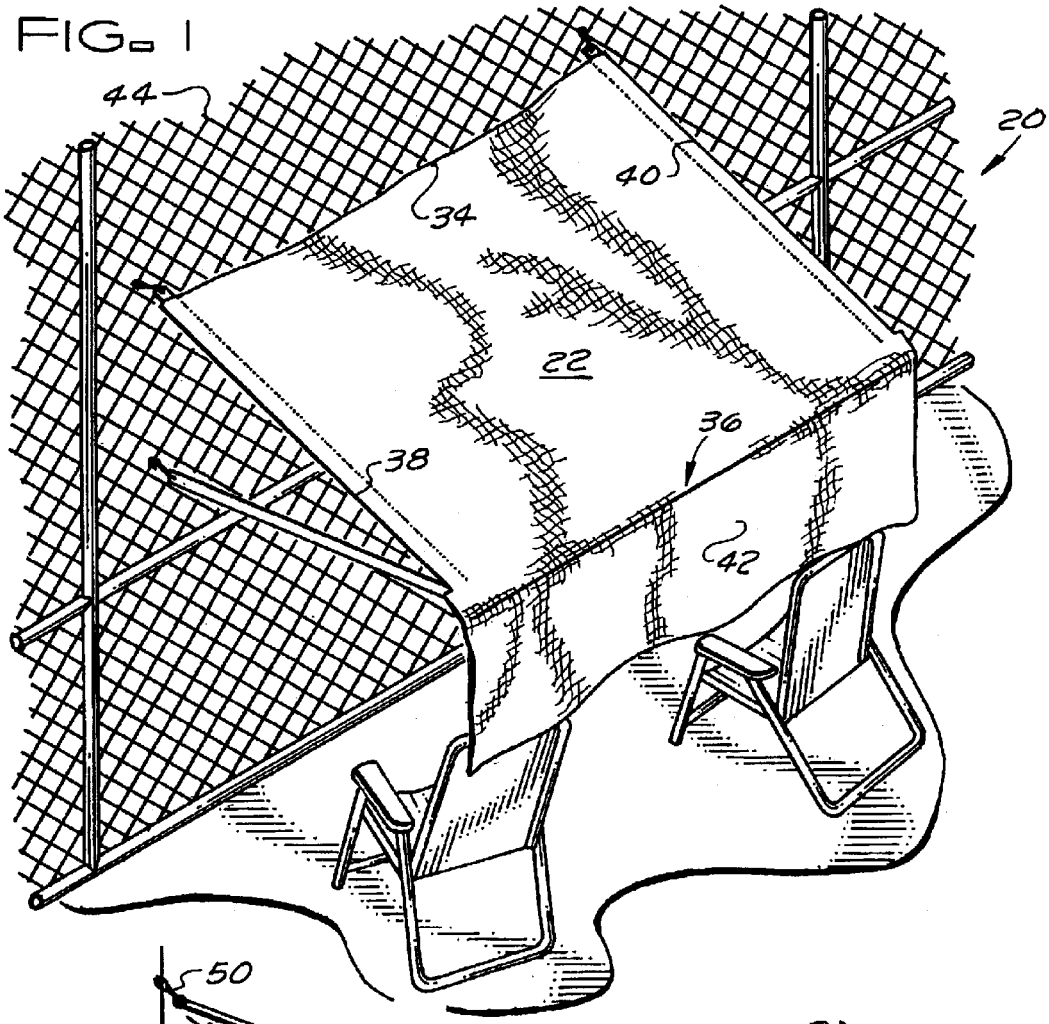
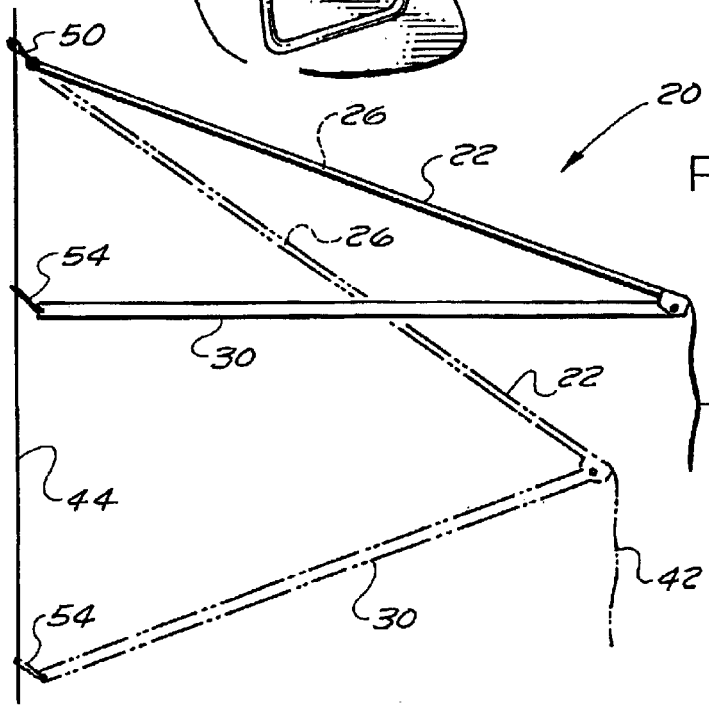
FIG. 2

PORTABLE FENCE SUPPORTED AWNING

BACKGROUND OF THE INVENTION

The subject invention relates to a portable awning, and, more specifically, to a portable, easy to carry, easy to setup, easy to take down awning that in use is supported by the attachment of the awning's frame members to a fence or similar structure commonly found at athletic fields and similar fields where athletic and/or other outdoor events are held.

Many athletic fields and other fields where athletic and/or other outdoor events are held lack shelter from the sun and rain for either the spectators or participants. This is especially true of the neighborhood and municipal athletic fields that are commonly used by children's athletic leagues, such as but not limited to little league baseball and other little league sports, and amateur adult athletic leagues, such as but not limited to amateur adult softball leagues and other athletic leagues. The lack of any shelter from the sun and rain for the players at these facilities when the players are off the field and for the spectators can not only lead to discomfort but to health problems. Over exposure to the sun, especially in warmer climates, can result in discomfort and can even lead to dehydration, heat stroke, or heat exhaustion for both the spectators and players off the field of play. Exposure to rain can dampen an otherwise fun filled outing for spectators as well as players who are off the field of play. Frequently, these athletic and similar fields have fences and/or backstops, such as but not limited to chain link fences and backstops, and similar structures adjacent the playing fields.

U.S. Pat. No. 6,050,280 discloses a sports shade that can be erected in conjunction with a ball field fence to provide shade adjacent a ball field for the players when the players are not on the field. While the sports shade of the '280 patent provides shade, the sports shade of the '280 patent has support legs 18 that, in use, can become obstructions. The sports shade of the '280 patent also utilizes guy lines 19 and stakes 28 that can trip a person or otherwise become obstructions. In addition, hammering the stakes 28 into the ground takes time and in many locations the ground can be quite hard or even paved, especially outside the fence where the spectators are located, making the use of stakes difficult and impractical if not impossible. While the support legs 18 are telescoping, the need d for the support legs to be in contact with the ground limits the ground clearance of the sports shade.

Thus, there has been a need to provide an awning for use in conjunction with fences and similar structures adjacent athletic and similar fields where athletic and/or other outdoor events are held that is inexpensive, compact, easy to carry, easy to setup, easy to take down, and free of obstructions over which people can trip. The portable fence supported awning of the subject invention fulfills all of the above needs and does not require the use of ground support legs, guy lines or stakes that must be driven into the ground.

SUMMARY OF THE INVENTION

The portable fence supported awning of the subject invention includes a flexible sheet, a rear frame cross member and first, second, third, and fourth lateral frame members. The rear frame cross member extends between lateral edge portions of the flexible sheet and parallel to a front edge of the flexible sheet. The rear frame cross member has a first end adjacent one lateral edge portion of the flexible sheet and a second end adjacent the other lateral edge portion of the flexible sheet.

The first lateral frame member has a first end pivotally joined through a first multi-pivotal joint assembly to the first end of the rear frame cross member so that the first lateral frame member can be pivoted from a first stored position extending generally parallel and adjacent to the rear frame cross member to a second in use position extending generally perpendicular to the rear frame cross member. The second lateral frame member has a first end pivotally joined through a second multi-pivotal joint assembly to the second end of the rear frame cross member so that the second lateral frame member can be pivoted from a first stored position extending generally parallel and adjacent to the rear frame cross member to a second in use position extending generally perpendicular to the rear frame cross member. The lateral edge portions of the flexible sheet are secured to the first and second lateral frame members and preferably extend at least from the first end to the second end of the first and second lateral frame members. Snap fasteners or other quick release fasteners are mounted on the second ends of the first and second lateral frame members and extend beyond the front edge of the flexible sheet for securing the first and second lateral frame members to a fence.

The third and fourth lateral frame members are about equal to or greater in length than the lengths of the first and second lateral frame members. The third lateral frame member has a first end that is pivotally joined through the first multi-pivotal joint assembly to the first end of the rear frame cross member so that the third lateral frame member can be pivoted from a first stored position extending generally parallel and adjacent to the rear frame cross member to a second in use position extending generally perpendicular to the rear frame cross member. The first end of the third lateral frame member is also pivotally joined through the first multi-pivotal joint assembly to the first end of the first lateral frame member so that the first and third lateral frame members can be pivoted relative to each other to adjust the spacing between the second ends of the first and third lateral frame members for mounting the awning on a fence. The fourth lateral frame member has a first end that is pivotally joined through the second multi-pivotal joint assembly to the second end of the rear frame cross member so that the fourth lateral frame member can be pivoted from a first stored position extending generally parallel and adjacent to the rear frame cross member to a second in use position extending generally perpendicular to the rear frame cross member. The first end of the fourth lateral frame member is also pivotally joined through the second multi-pivotal joint assembly to the first end of the second lateral frame member so that the second and fourth lateral frame members can be pivoted relative to each other to adjust the spacing between the second and fourth lateral frame members for mounting the awning on a fence. Snap fasteners or other quick release fasteners are mounted on the second ends of the third and fourth lateral frame members for securing the third and fourth lateral frame members to a fence.

As used herein, the term "fence" includes chain link fences, backstops and similar fence type structures to which the portable fence supported awning of the subject invention can be attached by snap fasteners, hook fasteners, or other quick release fasteners.

BRIEF DESCRIPTION OF THE DRAWINGS

FIG. 1 is a perspective view of a portable fence supported awning of the subject invention mounted on a fence.

FIG. 2 is a schematic side view of a portable fence supported awning of the subject invention showing the portable fence supported awning supported in two different positions where the first and second lateral frame members are above the third and fourth lateral frame members.

DESCRIPTION OF THE PREFERRED EMBODIMENTS

Figure 3:
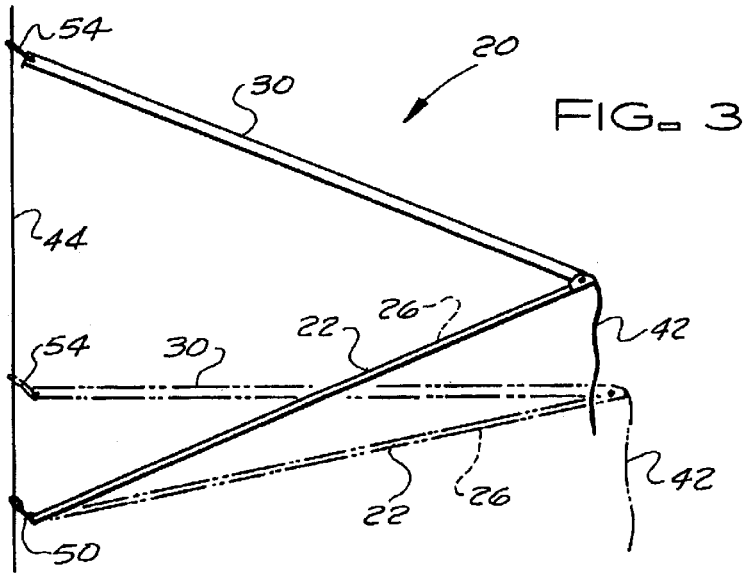
FIG. 3 is a schematic side view of a portable fence supported awning of the subject invention showing the portable fence supported awning supported in two different positions where the first and second lateral frame members are below the third and fourth lateral frame members.
Figure 4:
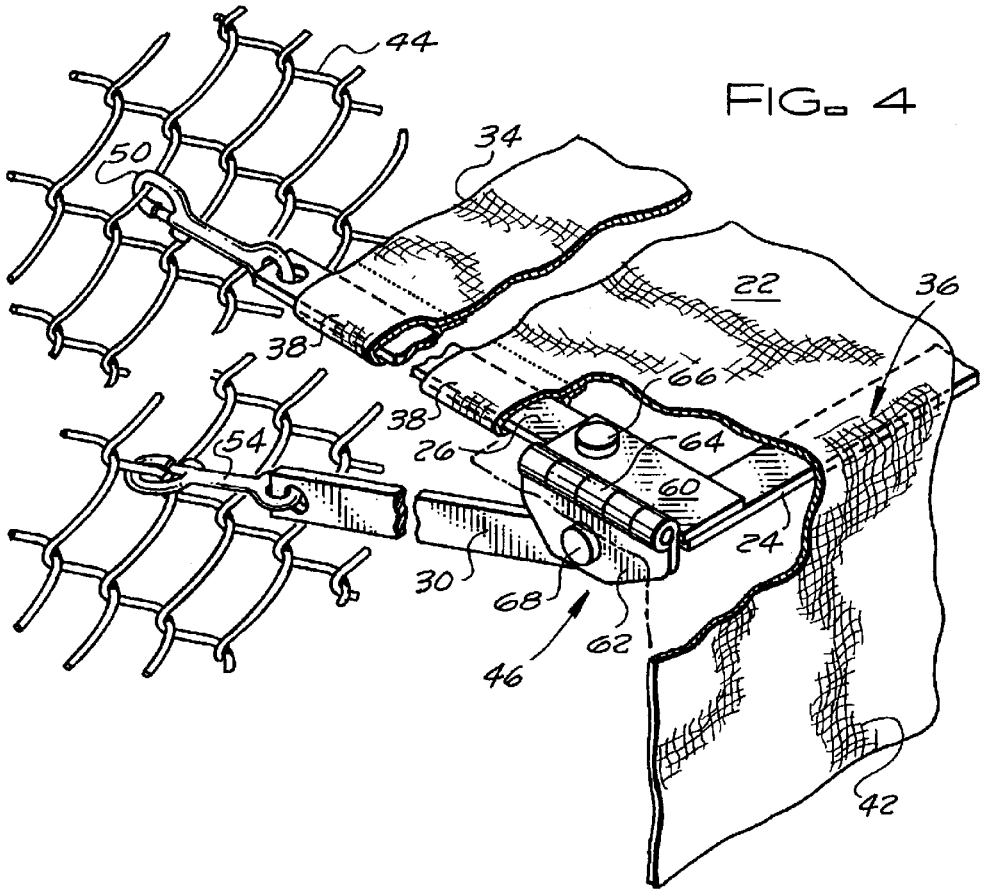
FIG. 4 is a partial perspective view on a larger scale than FIG. 1 of the portable fence supported awning with a portion of the awning sheet broken away to show one of the multi-pivotal joint assemblies.
Figure 5:
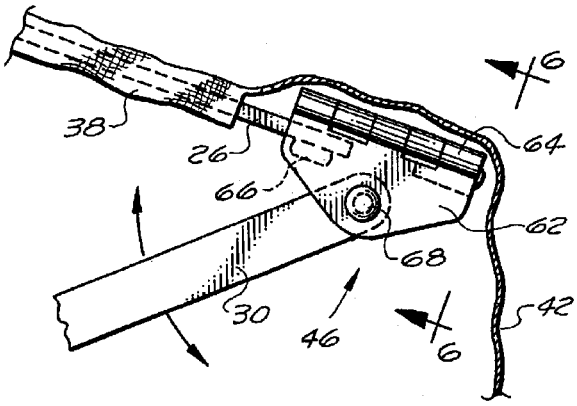
FIG. 5 is a side view of the multi-pivotal joint assembly of FIG. 4.
Figure 6:
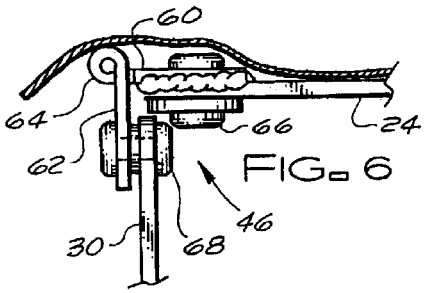
FIG. 6 is a view of the multi-pivotal joint assembly of FIGS. 4 and 5 taken substantially along lines 6—6 of FIG. 5.

The portable fence supported awning 20 of the subject invention includes a flexible sheet 22, a rear frame cross member 24 and first, second, third, and fourth lateral frame members 26, 28, 30 and 32 respectively. The flexible sheet 22 has a front edge 34, a rear portion 36, and first and second lateral edge portions 38 and 40 that extend from the front edge 34 to the rear edge portion 36. Preferably, the rear portion 36 of the flexible sheet 22 includes a flap 42 that is draped over and hangs down from the rear frame cross member 24 when the portable fence supported awning 20 is mounted on a fence 44 and that can be used to wrap the portable fence supported awning for carrying and storage.

The rear frame cross member 24 extends between lateral edge portions 38 and 40 of the flexible sheet 22 and, when the awning 20 is set up, extends parallel to the front edge 34 of the flexible sheet 22. The rear frame cross member 24 has a first end adjacent the first lateral edge portion 38 of the flexible sheet 22 and a second end adjacent the second lateral edge portion 40 of the flexible sheet 22.

Figure 7:
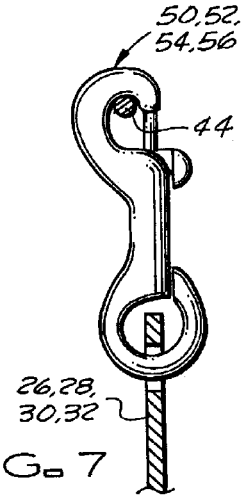
FIG. 7 is a side view, partially in section, showing a snap fastener mounted on an end of one of the lateral frame members and attached to a fence.
Figure 8:
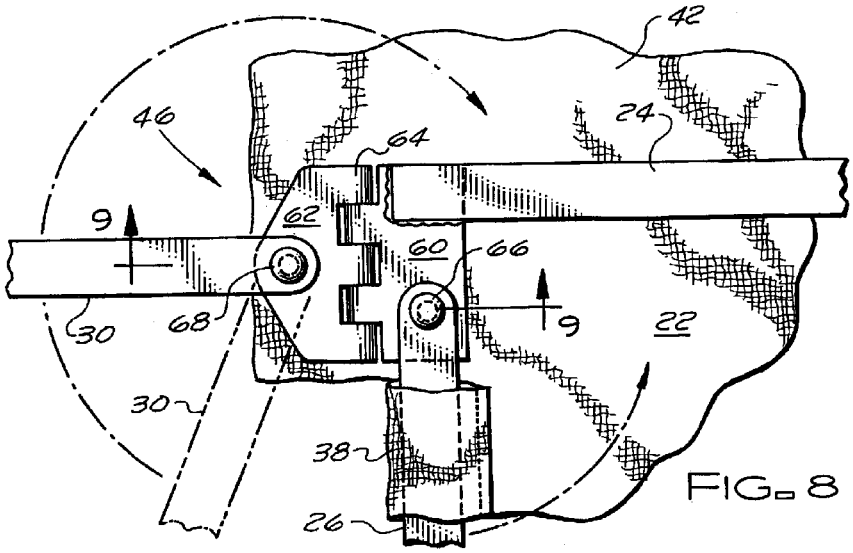
FIG. 8 is a bottom view of the multi-pivotal joint assembly of FIGS. 4, 5 and 6 with one of the joint components pivoted to a different position so that both of the lateral frame members joined to the rear frame member by the multi-pivotal joint assembly can be pivoted to positions parallel to the rear frame member for storage.
Figure 9:
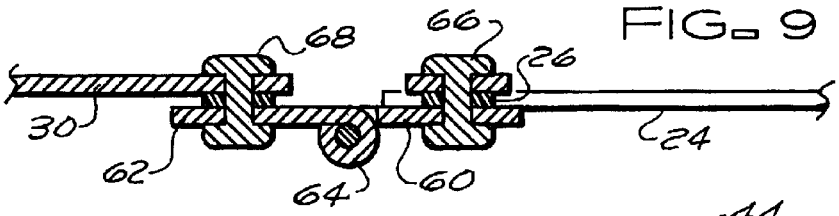
FIG. 9 is a section through the multi-pivotal joint assembly as shown in FIG. 8 and taken substantially along lines 9—9 of FIG. 8.
Figure 10:
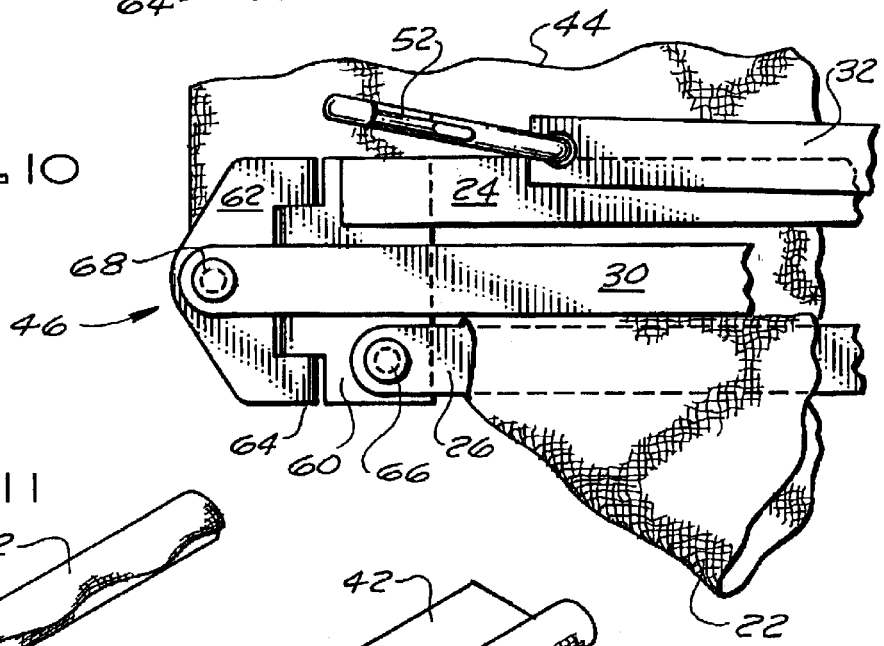
FIG. 10 is a bottom view of the multi-pivotal joint assembly of FIGS. 4, 5 and 6 with the multi-pivotal joint assembly in the position shown in FIG. 8 and both of the lateral frame members that are joined to the rear frame member by the multi-pivotal joint assembly positioned parallel to the rear frame member for storage.

The first lateral frame member 26 has a first end pivotally joined through a first multi-pivotal joint assembly 46 to the first end of the rear frame cross member 24 so that the first lateral frame member 26 can be pivoted from a first stored position extending generally parallel and adjacent to the rear frame cross member 24 to a second in use position extending generally perpendicular to the rear frame cross member 24. The second lateral frame member 28 has a first end pivotally joined through a second multi-pivotal joint ass mbly 48 to the second end of the rear frame cross member 24 so that the second lateral frame member 28 can be pivoted from a first stored position extending generally parallel and adjacent to the rear frame cross member 24 to a second in use position extending generally perpendicular to the rear frame cross member 24. The lateral edge portions 38 and 40 of the flexible sheet 22 are secured by hems or other fastening means to the first and second lateral frame members 26 and 28 and preferably extend at least from the first ends to the second ends of the first and second lateral frame members 26 and 28. Fasteners 50 and 52, such as but not limited to snap fasteners or other quick release fasteners are mounted on the second ends of the first and second lateral frame members 26 and 28 and extend beyond the front edge 34 of the flexible sheet 22 for securing the first and second lateral frame members 26 and 28 to a fence 44. Preferably, the fasteners for securing the first and second lateral frame members 26 and 28 to a fence 44 lock onto the fence as shown in FIG. 7 and must be manually released by the user to prevent the first and second lateral frame members 26 and 28 from accidentally becoming detached from a fence.

Normally, the third and fourth lateral frame members 30 and 32 are about equal to or greater in length than the lengths of the first and second lateral frame members 26 and 28. The third lateral frame member 30 has a first end that is pivotally joined through the first multi-pivotal joint assembly 46 to the first end of the rear frame cross member 24 so that the third lateral frame member 30 can be pivoted from a first stored position extending generally parallel and adjacent to the rear frame cross member 24 to a second in use position extending generally perpendicular to the rear frame cross member 24. The first end of the third lateral frame member 30 is also pivotally joined through the first multi-pivotal joint assembly 46 to the first end of the first lateral frame member 26 so that the first and third lateral frame members 26 and 30 can be pivoted relative to each other in a generally vertical plane to position the first and third lateral frame members for mounting the awning 20 on a fence 44. The fourth lateral frame member 32 has a first end that is pivotally joined through the second multi-pivotal joint assembly 48 to the second end of the rear frame cross member 24 so that the fourth lateral frame member 32 can be pivoted from a first stored position extending generally parallel and adjacent to the rear frame cross member 24 to a second in use position extending generally perpendicular to the rear frame cross member 24. The first end of the fourth lateral frame member 32 is also pivotally joined through the second multi-pivotal joint assembly 48 to the first end of the second lateral frame member 28 so that the second and fourth lateral frame members 28 and 32 can be pivoted relative to each other in a generally vertical plan to position the second and fourth lateral frame members for mounting the awning 20 on a fence 44. Fasteners, such as but not limited to snap fasteners 54 and 56 or other quick release fasteners are mounted oh the second ends of the third and fourth lateral frame members 30 and 32 for securing the third and fourth lateral frame members 30 and 32 to a fence 44. Preferably, the fasteners for securing the third and fourth lateral frame members 30 and 32 to a fence 44 lock onto the fence as shown in FIG. 7 and must be manually released by the user to prevent the third and fourth lateral frame members 30 and 32 from accidentally becoming detached from a fence.

The preferred embodiments of the multi-pivotal joint assemblies 46 and 48 are mirror images of each other. Accordingly, only the multi-pivotal joint assembly 46 will be described in detail to avoid repetition. The multi-pivotal joint assembly 46 includes a first plate 60 and a second plate 62 that are pivotally joined together by a hinge joint 64 so that the second plate 62 can be pivoted relative to the first plate 60 from a first position where the first and second plates 60 and 62 lie in a common plane when the awning 20 is not in use to either a second position or a third position, when the awning 20 is in use, where the second plate 62 extends perpendicular to and downward from the first plate 60 or extends perpendicular to and upward from the first plate 60. The first plate 60 is welded or otherwise secured in a fixed position to first end of the rear frame cross member 24. The first end of the first lateral frame member 26 is pivotally secured to the first plate 60 by a rivet joint 66 or similar joint so that the first lateral frame member 26 can be pivoted in a plane containing the rear frame cross member 24 from a first position where the first lateral frame member 26 extends parallel and adjacent to the rear frame cross member 24 when the awning 20 is not in use to a second position when the awning 20 is in use where the first lateral frame member 26 extends perpendicular to the rear frame cross member 24 to secure the first lateral frame member 26 to a fence. The first end of the third lateral frame member 30 is pivotally secured to the second plate 62 by a rivet joint 68 of similar joint. With the first and second plates 60 and 62 lying in the common plane when the awning 20 is not in use, the third lateral frame member 30 can be placed in a first position where the third lateral frame member 30 extends parallel and adjacent to the rear frame cross member 24. With the second plate pivoted about the hinge joint 64 to its second or third position when the awning 20 is in use, where the second plate 62 extends perpendicular to and downward from the first plate 60 or extends perpendicular to and upward from the first plate 60, the third lateral frame member 30 can be pivoted about the rivet joint 68 in a vertical plane relative to the first lateral frame member 26 to locate the third lateral frame member 30 relative to the first lateral frame member 26 and secure the third lateral frame member 30 to a fence. The vertical plane in which the third lateral frame member 30 pivots relative to the first lateral frame member 26 when the second plate 62 is in its second or third position lies generally perpendicular to the plane containing the rear frame cross member 24.

Figure 11:
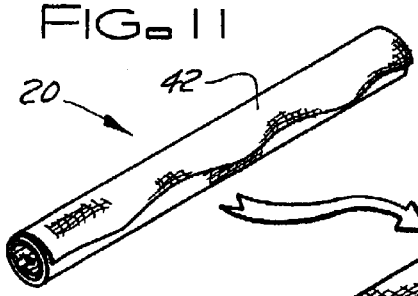
FIGS. 11 to 19 show a portable fence supported awning of the subject invention being unwrapped, unfolded and setup for mounting on a fence.
Figure 12:
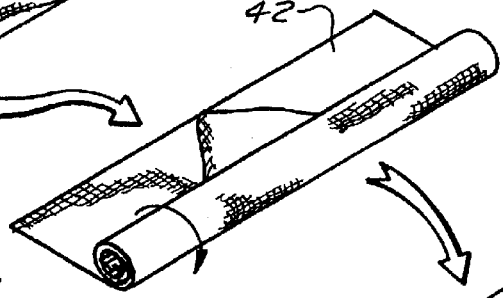
Figure 13:
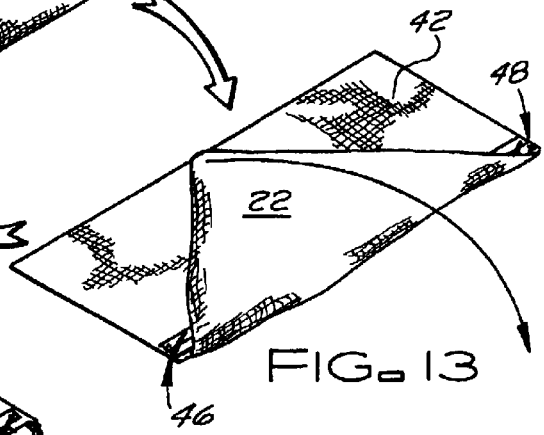
Figure 14:
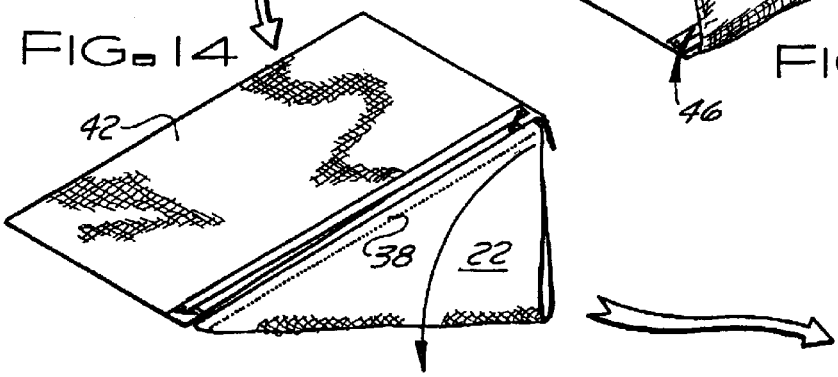
Figures 15, 16, 17:
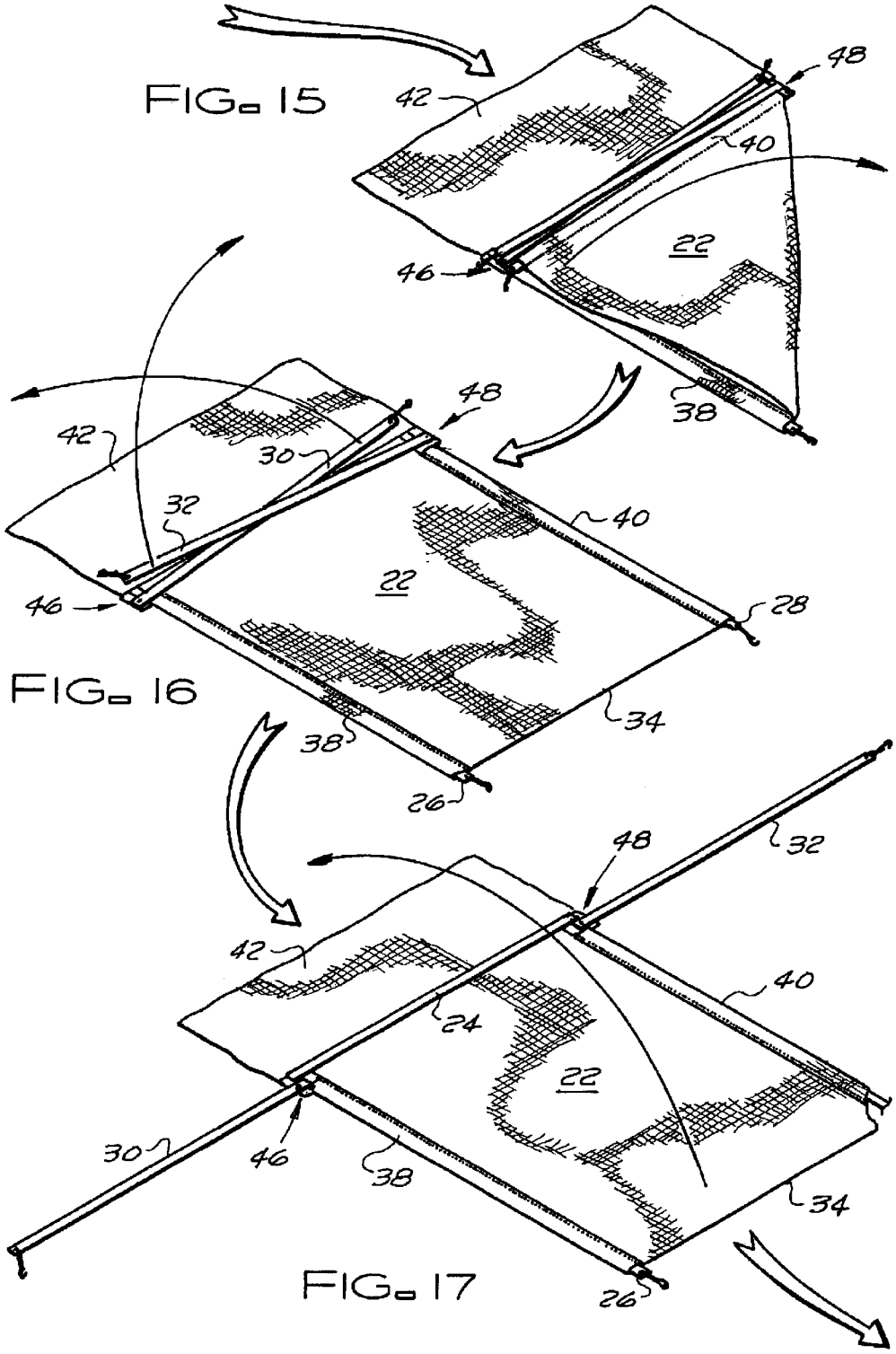
Figure 18:
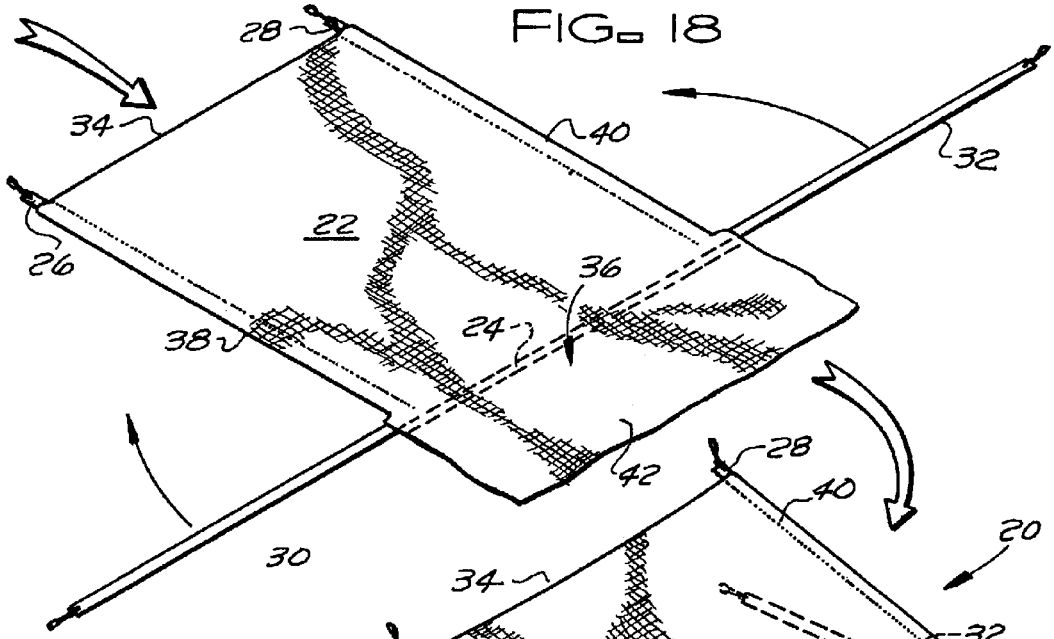
Figure 19:
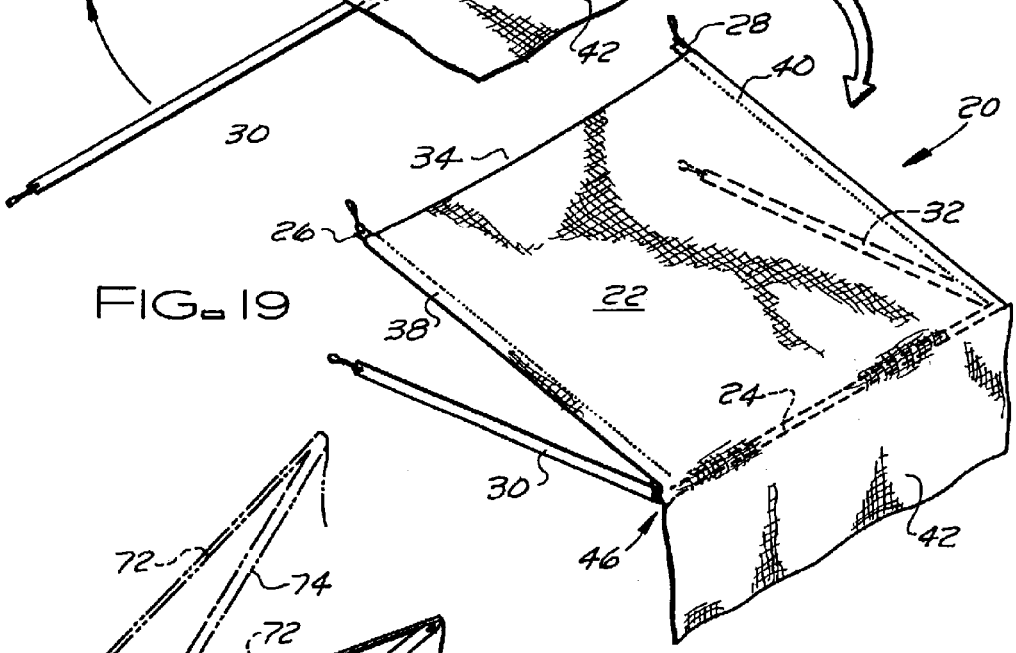

FIGS. 11 to 19 show the awning 20 being readied for mounting on a fence. In FIG. 11, the awning 20, with the flexible sheet 22 folded for storage and the frame members all extending generally parallel and adjacent to each other, is wrapped in the flap 42. FIGS. 12 and 13 show the flap 42 being unwrapped from about the flexible sheet 22 and frame members and the flexible sheet 22 being unfolded. In FIG. 14, the flap 42 has been unwrapped and the flexible sheet has been unfolded to expose the frame members. FIGS. 15 and 16 show the flexible sheet 22 being further unfolded and laid out flat with the first and second lateral frame members 26 and 28 being pivoted, through the multi-pivotal joint assemblies 46 and 48, from the positions where these frame members extend parallel to and adjacent the rear frame cross member 24 to positions extending perpendicular to the rear frame cross member 24. FIGS. 16 and 17 shown the third and fourth lateral frame members 30 and 32 being pivoted, through the multi-pivotal joint assemblies 46 and 48, from positions where these frame member extend parallel and adjacent to the rear frame member to positions where the third and fourth lateral frame members 30 and 32 still extend generally parallel to but laterally away from the rear frame cross member 24. In FIGS. 17 and 18, the awning is flipped over so that the rear portion 36 of the flexible sheet 22 with its flap 42 is draped over the rear frame cross member 24. In FIG. 19, the third and fourth lateral frame members 30 and 32 have been pivoted through the multi-pivotal joint assemblies 46 and 48 so that the third and fourth lateral frame members 30 and 32 can be pivoted in vertical planes to adjust their positions relative to the first and second lateral frame members 26 and 28 for mounting the awning 20 on a fence.

Figure 20:
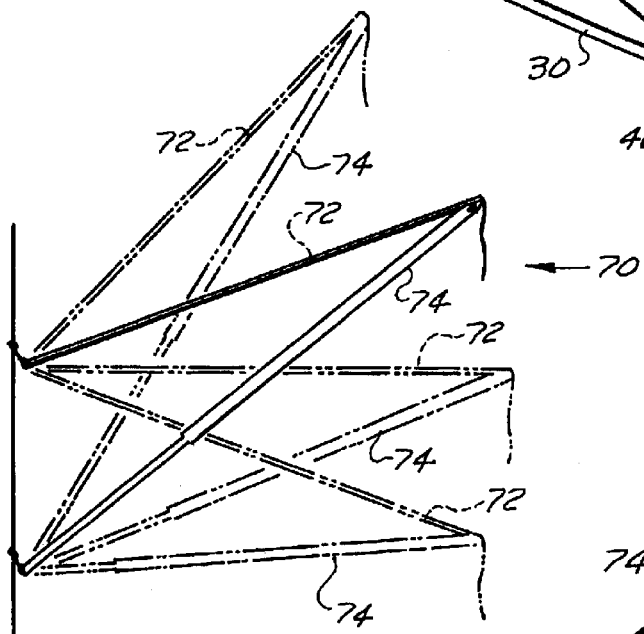
FIG. 20 is a schematic side view of an embodiment of the portable fence supported awning of the subject invention wherein the third and fourth lateral frame members are telscoping lateral frame members. The Figure shows the portable fence supported awning in several different positions with the first and second lateral frame members above the third and fourth lateral frame members and the third and fourth lateral frame members adjusted to different lengths.
Figure 21:
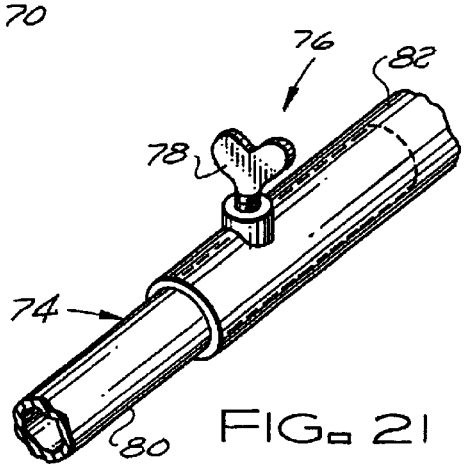
FIG. 21 is a detail of a telescoping mechanism that may be used in the third and fourth lateral frame members of FIG. 20.

FIG. 20 schematically shows another embodiment of the awning of the subject invention. The awning 70 of FIG. 20 is the same as the awning 20 with one exception. The third and fourth lateral frame members are adjustable in length to adjust the attitude of the awning 70 to a desired angle for shading or covering a particular area. Only the first and third lateral frame members 72 and 74 are shown. FIG. 21 shows an example of a length adjusting mechanism on the lateral frame member 74, telescoping mechanism 76, which can be us d on the third and fourth lateral frame members of awning 70 to adjust the lengths of those lateral frame members. The clamping screw 78 can be loosened to slide one section 80 of the lateral frame member 74 relative to the other section 82 of the lateral frame member 74 and tightened to clamp the sections 80 and 82 of the lateral frame member 74 in place when the lateral frame member has been adjusted to a desired length.

The frame members of the awnings 20 and 70 can be made of stainless steel, aluminum, polymeric, or other materials that are rigid or sufficiently rigid to remain straight or essentially straight in use to retain the awning in the shape shown in FIG. 1. The flexible sheet 22 may be made of various materials, such as but not limited to: flexible, opaque fabric or sheet materials; flexible, opaque, water repellant fabric or sheet materials; flexible, vinyl coated synthetic fiber reinforced sheet materials; polymeric sheet materials; sunscreen fabrics; nettings; canvas; or similar sheet materials. The sheet material may be imprinted with logos, team mascots, insignias, advertising, etc. An example of a typical awning 20 that provides shade and cover for a single person has frame members between about 4½ and about 6 feet long with the main portion of the flexible sheet 22 being between about 4½ and about 6 feet long by between about 4½ and about 6 feet wide to conform to the lengths of the frame members and having a rear flap 42 about 1 to 2 feet in length.

In describing the invention, certain embodiments have been used to illustrate the invention and the practices thereof. However, the Invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A portable fence supported awning, comprising:

a flexible sheet; the flexible sheet having a front edge, a rear portion, and first and second lateral edge portions extending between the front edge and the rear portion;

a rear frame cross member, the rear frame cross member extending between the first and second lateral edge portions of the flexible sheet; the rear frame cross member having a first end adjacent the first lateral edge portion of the flexible sheet; the rear frame cross member having a second end adjacent the second lateral edge portion of the flexible sheet; and the rear frame cross member extending parallel to the front edge of the flexible sheet;

a first lateral frame member; the first lateral member having first and second ends and a length; a first pivoting means comprising a first fixed hinge plate secured in a fixed position to the first end of the rear frame cross member; the first lateral frame member being pivotally joined to the first plate whereby the first end of the first lateral frame member is pivotally joined to the first end of the rear frame cross member so that the first lateral frame member can be pivoted from a first stored position extending generally parallel to the rear frame cross member to a second in use position extending generally perpendicular to the rear frame cross member; the first lateral edge portion of the flexible sheet being secured to the first lateral frame member and extending from about the first end to about the second end of the first lateral frame member; quick release fastening means at the second end of the first lateral frame member and extending beyond the front edge of the flexible sheet for securing the first lateral frame member to chain links of a fence;

a second lateral frame member; the second lateral frame member having first and second ends and a length; a second pivoting means comprising a second fixed hinge plate secured in a fixed position to the second end of the rear frame cross member; the second lateral frame member being pivotally joined to the second fixed plate whereby the first end of the second lateral frame member is pivotally joined to the second end of the rear frame cross member so that the second lateral frame member can be pivoted from a first stored position extending generally parallel to rear frame cross member to a second in use position extending generally perpendicular to the rear frame cross member; the second lateral edge position of the flexible sheet being secured to the second lateral frame member and extending from about the first end to about the second end of the second lateral frame member; quick release fastening means at the second end of the second lateral frame member and extending beyond the front edge of the flexible sheet for securing the second lateral frame member to chain links of a fence;

a third lateral frame member; the third lateral frame member having first and second ends and a length about equal to or greater than the length of the first lateral frame member; the first pivoting means including a first pivoting plate hinged to the first fixed plate; the third lateral frame member being pivotally joined to the first pivoting plate whereby the first end of the third lateral frame member is pivotally joined to the first end of the rear frame cross member so that the third lateral frame member can be pivoted from a first stored position generally parallel to the rear frame cross member to a second in use position extending generally perpendicular to the rear frame cross member; the first pivoting means pivotally joining the first end of the third lateral frame member to the first end of the first lateral frame member so that the first and third lateral frame members can be pivoted relative to each other for mounting the awning on a fence and the first pivoting plate being pivotal from a first position extending downward from the first fixed plate that enables the third lateral frame member to extend to a fence below the first lateral frame member to a second position extending upward from the first fixed plate that enables the third lateral frame member to extend to a fence above the first lateral frame member; quick release fastening means at the second end of the third lateral frame member for securing the third lateral frame member to chain links of a fence; and a fourth lateral frame member; the fourth lateral frame member having first and second ends and having a length about equal to or greater than the length of the second lateral frame member; the second pivoting means including a second pivoting plate hinged to the second fixed plate; the third lateral frame member being pivotally joined to the second pivoting plate whereby the first end of the fourth lateral frame member is pivotally joined to the second end of the rear frame cross member so that the fourth lateral frame member can be pivoted from a first stored position extending generally parallel to the rear frame cross member to a second in use position extending generally perpendicular to the rear frame cross member; the second pivoting means pivotally joining the first end of the fourth lateral frame member to the first end of the second lateral frame member so that the second and fourth lateral frame members can be pivoted relative to each other for mounting the awning on a fence and the second pivoting plate being pivotal from a first position extending downward from the second fixed plate that enables the fourth lateral frame member to extend to a fence below the second lateral frame member to a second position extending upward from the second fixed plate that enables the fourth lateral frame member to extend to a fence above the second lateral frame member; quick release fastening means at the second end of the fourth lateral frame member for securing the fourth lateral frame member to chain links of a fence.

2. The portable awning according to claim 1, wherein:

the flexible sheet is a sunscreen.

3. The portable awning according to claim 1, wherein:

the flexible sheet is sunscreen and is water-repellant.

4. The portable awning according to claim 1, wherein:

the flexible sheet is opaque.

5. The portable awning according to claim 1, wherein:

the flexible sheet is opaque and is water-repellant.

6. The portable awning according to claim 1, wherein:

the rear portion of the flexible sheet includes a flap that is draped over the rear frame cross member that may be used to wrap the awning when the lateral frame members are pivoted into and the flexible sheet is folded into a stored state.

7. The portable awning according to claim 1, wherein:

the third and fourth lateral frame member are adjustable in length for adjusting the altitude of the awning when the awning is mounted on a fence.

8. The portable awning according to claim 7, wherein: the flexible sheet is a sunscreen.

9. The portable awning according to claim 7, wherein: the flexible sheet is a sunscreen and is water-repellant.

10. The portable awning according to claim 7, wherein: the flexible sheet is opaque.

11. The portable awning according to claim 7, wherein: the flexible sheet is opaque and is water-repellant.

12. The portable awning according to claim 7, wherein: the rear portion of the flexible sheet includes a flap that is draped over the rear frame cross member that may be used to wrap the awning when the lateral frame members are pivoted into and the flexible sheet is folded into a stored state.

13. The portable awning according to claim 1, wherein: the quick release fastening means are snap fasteners.

* * * * *